US008414429B2

(12) United States Patent
Belt

(10) Patent No.: US 8,414,429 B2
(45) Date of Patent: Apr. 9, 2013

(54) ADJUSTABLE HEIGHT AND POSITION BATTING TEE

(76) Inventor: Tony Belt, Shelby, NE (US)

( * ) Notice: Subject to any disclaimer, the term of this patent is extended or adjusted under 35 U.S.C. 154(b) by 0 days.

(21) Appl. No.: 13/022,739

(22) Filed: Feb. 8, 2011

(65) Prior Publication Data

US 2012/0202621 A1 Aug. 9, 2012

(51) Int. Cl.
*A63B 69/00* (2006.01)
*A63B 69/40* (2006.01)

(52) U.S. Cl.
USPC ..... 473/417; 473/422; 473/451

(58) Field of Classification Search ..... 473/417, 473/422, 430, 429; D21/715
See application file for complete search history.

(56) References Cited

U.S. PATENT DOCUMENTS 3,550,938 A * 12/1970 Cunningham, Jr. ..... 473/429
4,664,374 A * 5/1987 Groves ..... 473/417
D321,545 S * 11/1991 Myers ..... D21/715
5,320,343 A * 6/1994 McKinney ..... 473/417
5,928,092 A * 7/1999 Keeter et al. ..... 473/417
6,475,108 B1 * 11/2002 Sarenana et al. ..... 473/420
6,878,077 B2 * 4/2005 Andrews ..... 473/453
7,226,373 B2 * 6/2007 Arenas ..... 473/417
7,465,243 B2 * 12/2008 Cramer ..... 473/417
7,641,573 B2 * 1/2010 Cech ..... 473/417
7,771,294 B2 * 8/2010 Goucher et al. ..... 473/451
8,033,934 B1 * 10/2011 Clancy ..... 473/430
2007/0082762 A1 * 4/2007 Falgoust ..... 473/453

* cited by examiner

*Primary Examiner* — Mitra Aryanpour
(74) *Attorney, Agent, or Firm* — Jerry D. Haynes; Law Office of Jerry D. Haynes.

(57) ABSTRACT

An adjustable position batting tee comprising a base, where the base rests upon the ground; a central tube rising vertically from the base; a rotatable collar that wraps around the central tube, where the rotatable collar twists around the central tube; a central tee extending vertically from the central tube, where the central tee enables a ball to rest upon a top portion; a side bar fastened to the rotatable collar, where the side bar extends horizontally from a side portion of the rotatable collar; and a lateral tee extending vertically from the side bar, wherein the lateral tee enables a ball to rest upon a top portion of the lateral tee.

2 Claims, 1 Drawing Sheet

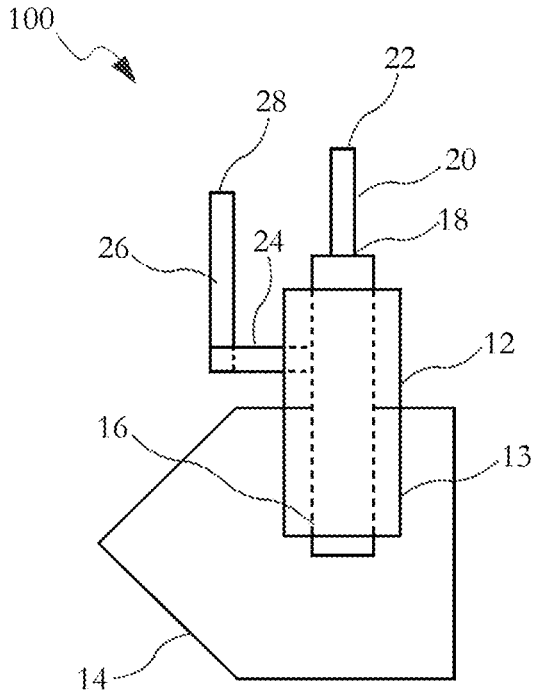
100
22
28
20
18
26
24
12
16
13
14

ADJUSTABLE HEIGHT AND POSITION BATTING TEE

BACKGROUND OF THE INVENTION

1. Field of the Invention

The present invention relates to a batting tee that provides a user with various ball placement positions to help the user improve their batting technique.

2. Description of Related Art

As favorite pastime shared by many individuals, baseball brings together young and old alike. Along with watching baseball many people enjoy playing the sport whether it's for recreational fun or a professional career. To improve their batting technique, a common practice tool for baseball players is a batting tee. The batting tees are typically a pole or tube that extends vertically from a base. The player simply rests a ball on top of the tube and then practices their batting by hitting the ball while resting in a stationary and elevated position. With the tee the player may then improve their swing speed, angle, batting stance and many other batting techniques.

While standard batting tees remain stationary some improvements have been made to enable the player to move and adjust the ball position. U.S. Pat. No. 5,004,234 by Ray A. Hollis discloses an adjustable batting tee wherein the base provides two attachment points to accept a vertical pole upon which to rest the ball. Additionally the base includes a set of slots to enable the attachment points to move upon the base.

Furthermore, U.S. Pat. No. 5,388,823 by Ronald G. Prieto discloses an adjustable baseball batting tee wherein the base includes a track that allows the supporting pole for the baseball to move back and forth along the track. The track enables the user to change the position of the ball for practice. While these batting tees do allow the user to change the placement of the ball they primarily implement adjustments along the base. This may be potentially dangerous to the user in case they catch or pinch their finger in the track or slot. Also the tracks and slots in the base are burdensome and time consuming for adjustments.

It would be beneficial in the art to provide a batting tee that that is adjustable and allows the user to easily adjust the placement of the ball. It would also be desirable in the art to provide a batting tee that provides more than one placement location for the ball.

SUMMARY OF THE INVENTION

In view of the foregoing disadvantages inherent in the prior art, the purpose of the present disclosure is to provide a batting tee that provides a user with various ball placement positions to help the user improve their batting technique.

An object of the present invention is to provide a batting tee that enables a user to easily position a ball support to multiple hitting positions.

Another object of the present invention is to provide a batting tee that provides two ball supports which includes a central ball support and a lateral ball support which rotates around the central portion of the batting tee.

To achieve the above objects, in an aspect of the present invention, an adjustable position batting tee comprising a base, where the base rests upon the ground; a central tube rising vertically from the base; a rotatable collar that wraps around the central tube, where the rotatable collar twists around the central tube; a central tee extending vertically from the central tube, where the central tee enables a ball to rest upon a top portion; a side bar fastened to the rotatable collar, where the side bar extends horizontally from a side portion of the rotatable collar; and a lateral tee extending vertically from the side bar, wherein the lateral tee enables a ball to rest upon a top portion of the lateral tee.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawing in which:

FIG. 1 depicts a perspective view of an adjustable position batting tee in accordance with an exemplary embodiment of the present invention.

DETAILED DESCRIPTION OF THE DRAWINGS

The present invention relates to a batting tee that provides a user with various ball placement positions to help the user improve their batting technique. The present invention provides an adjustable position batting tee which provides multiple ball supports to enable the user to practice their swing to correspond with different pitching techniques. The adjustable position batting tee utilizes a base with a vertically extending central tube. At the top portion of the central tube is a central ball support which receives a ball for practice. Around the central tube is a rotatable collar that anchors a lateral ball support. The lateral ball support provides an alternative ball placement location so that the user may rotate the support towards them to practice their batting for inside pitches or alternatively rotate the support away from them to practice batting for outside pitches. The adjustable position batting tee is perfect for users of varying batting styles, heights and abilities, and allows them to easily transition between the various ball placements.

Tuning now descriptively to the drawings, referring to FIG. 1, an adjustable position batting tee (10) is shown in accordance with an exemplary embodiment of the present invention. The adjustable position batting tee (10) includes a rotatable collar (12) that wraps around a central tube (16). The central tube (16) is attached and extends vertically from a base (14) that rests on the ground. The base (14) may be weighted to provide additional stability and to prevent the adjustable position batting tee (10) from tipping during use. The base (14) may be shaped like a standard pentagon batting plate for a realistic baseball feel, or it may have a rectangular or squared shape. While the rotatable collar (12) twists and turns around the central tube (16), both pieces remain upright against the base (14).

At a bottom portion of the rotatable collar (12) may be a set of wing nuts (13). The set of wing nuts (13) ensure that the rotatable collar (12) remains in one place without twisting during use. When a user wishes to change the position of the rotatable collar (12) they need to simply loosen the set of wing nuts (13), rotate the rotatable collar (12) to the preferred position and then tighten the set of wing nuts (13) for use.

Following up from the central tube (16) is a central tee (20) that extends from a hole (18) located in the center of the central tube (16). At the topmost part of the central tee (20) is a central ball support (22) that accepts a baseball or softball for use. The central tee (20) raises and lowers within the central tube (16) to adjust the height of the central ball support (22). The central ball support (22) may be rounded around the edges to better enable the ball to balance. By adjusting the height of the central tee (20) users of varying heights may use the same adjustable position batting tee (10). The various users are provided with a customized fit perfect for their individual preferences and batting styles.

Positioned on a side portion of the rotatable collar (12) is a side bar (24). The side bar (24) extends perpendicularly from the rotatable collar (12) and is positioned at a fixed height. At an end of the side bar (24) a lateral tee (26) raises vertically running parallel to the rotatable collar (12). At the topmost portion of the lateral tee (26), a lateral ball support (28) rests to accept a baseball or softball. As the rotatable collar (12) twists around the central tube (16) so does the lateral tee (26) to allow the user to change the position of the lateral tee (26). The different positions of the lateral tee (26) may simulate inside and outside pitches across the batting plate. The lateral tee (26) and the central tee (20) enable the user to switch between various batting positions ranging from differing heights to extended lateral positions which will help improve their overall batting performance.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. An adjustable batting tee comprising:

a base, wherein the base rests upon the ground;

a central tube attached to and rises vertically from the base;

a central tee extending vertically upwardly from the central tube, the central tee includes a ball support for supporting a ball thereon;

a rotatable collar wrapped around the central tube as the central tee extends upwardly from the central tube;

a side bar fastened to the rotatable collar, wherein the side bar extends horizontally outwardly from a side portion of the rotatable collar; and a lateral tee extending vertically upwardly from the side bar, the lateral tee includes a ball support for supporting a ball thereon wherein the rotatable collar twists and turns around the central tube allowing the user to change the position of the lateral tee, wherein the different positions of the lateral tee may simulate inside and outside pitches across the base; the lateral tee and the central tee enable a user to switch between various batting positions which help improve the overall batting performance of the user.

2. The adjustable position batting tee according to claim 1, wherein the central tee raises and lowers within the central tube.

* * * * *